US012402714B2

(12) United States Patent
Lewis et al.

(10) Patent No.: US 12,402,714 B2
(45) Date of Patent: Sep. 2, 2025

(54) POSITIONABLE CARRIABLE DEVICE STRAP

(71) Applicant: LENOVO (SINGAPORE) PTE. LTD., Singapore (SG)

(72) Inventors: Sarah Lewis, Morrisville, NC (US); Julia Young, Morrisville, NC (US); Ali Ent, Morrisville, NC (US); Thomas Perelli, Morrisville, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 187 days.

(21) Appl. No.: 17/987,581

(22) Filed: Nov. 15, 2022

(65) Prior Publication Data

US 2024/0156238 A1 May 16, 2024

(51) Int. Cl.
*A45F 3/14* (2006.01)
*A45F 3/04* (2006.01)

(52) U.S. Cl.
CPC ..... *A45F 3/14* (2013.01); *A45F 2003/142* (2013.01)

(58) Field of Classification Search
CPC ..... A45F 3/14; A45F 3/047; A45F 2003/142
USPC ..... 224/153, 578, 579, 580, 183
See application file for complete search history.

(56) References Cited

U.S. PATENT DOCUMENTS 3,254,816 A * 6/1966 Gray ..... A45F 3/04 224/630
4,213,549 A * 7/1980 Hibbard ..... A45C 11/22 224/601
4,273,274 A * 6/1981 Freistadt ..... A45F 3/04 150/108
4,988,216 A * 1/1991 Lyman ..... A45C 11/20 383/110
5,957,354 A * 9/1999 Mentken ..... A45F 3/04 224/601
6,286,461 B1 * 9/2001 Martz ..... A01K 1/0254 119/497
6,460,746 B1 * 10/2002 Amram ..... A45F 3/047 224/628
6,622,899 B1 * 9/2003 Klindworth-Garron ..... A45F 3/02 224/625
7,160,028 B1 * 1/2007 Linday ..... A45C 9/00 150/108
8,092,087 B2 * 1/2012 Simhony ..... A45F 3/14 150/108
8,590,759 B1 * 11/2013 Mooney ..... A45F 3/04 224/645
9,303,353 B2 * 4/2016 Audet ..... D06F 95/002
10,130,161 B2 * 11/2018 Kao ..... A45F 3/12
10,230,077 B2 * 3/2019 Rief ..... H01M 50/247
10,407,216 B1 * 9/2019 Glass ..... B65D 33/00
11,470,947 B2 * 10/2022 Linday ..... A45C 9/00
2009/0101254 A1 * 4/2009 Vaccarella ..... A45C 13/26 150/108

(Continued)

*Primary Examiner* — Nathan J Newhouse
*Assistant Examiner* — Lester L Vanterpool
(74) *Attorney, Agent, or Firm* — Brian J. Pangrle

(57) ABSTRACT

A carriable device can include a body that includes a first side, a second, opposing side, a first strap mount on the first side, and a second strap mount socket on the second side; and a strap that includes an end attached to the body, an opposing end, and a coupling attached to the opposing end, where the coupling is connectable to the first strap mount and wherein the coupling is connectable to the second strap mount.

16 Claims, 10 Drawing Sheets

(56) References Cited

U.S. PATENT DOCUMENTS

| | | | | |
|---|---|---|---|---|
| 2009/0205759 | A1* | 8/2009 | Vaccarella | A45C 13/02 150/108 |
| 2015/0129627 | A1* | 5/2015 | Roberts | A45F 3/02 224/581 |
| 2021/0100340 | A1* | 4/2021 | Chang | A45F 3/047 |
| 2021/0376658 | A1* | 12/2021 | Marino | A45C 15/06 |

* cited by examiner

POSITIONABLE CARRIABLE DEVICE STRAP

TECHNICAL FIELD

Subject matter disclosed herein generally relates to carriable devices.

BACKGROUND

Carriable devices can include one or more straps, for example, a bag may include a single strap and a backpack may include two straps.

SUMMARY

A carriable device can include a body that includes a first side, a second, opposing side, a first strap mount on the first side, and a second strap mount socket on the second side; and a strap that includes an end attached to the body, an opposing end, and a coupling attached to the opposing end, where the coupling is connectable to the first strap mount and wherein the coupling is connectable to the second strap mount. Various other apparatuses, systems, methods, etc., are also disclosed.

BRIEF DESCRIPTION OF THE DRAWINGS

Features and advantages of the described implementations can be more readily understood by reference to the following description taken in conjunction with examples of the accompanying drawings.

DETAILED DESCRIPTION

The following description includes the best mode presently contemplated for practicing the described implementations. This description is not to be taken in a limiting sense, but rather is made merely for the purpose of describing general principles of various implementations. The scope of invention should be ascertained with reference to issued claims.

As an example, a carriable device can include a body that includes a first side, a second, opposing side, a first strap mount on the first side, and a second strap mount on the second side; and a strap that includes an end attached to the body, an opposing end, and a coupling attached to the opposing end, where the coupling is connectable to the first strap mount and wherein the coupling is connectable to the second strap mount.

As an example, a carriable device can include a body that includes a strap mount; and a strap that includes an end attached to the body, an opposing end, and a coupling attached to the opposing end, where the coupling is connectable to the strap mount, and where the opposing end of the strap is rotatable via the strap mount and the coupling.

Figure 1:
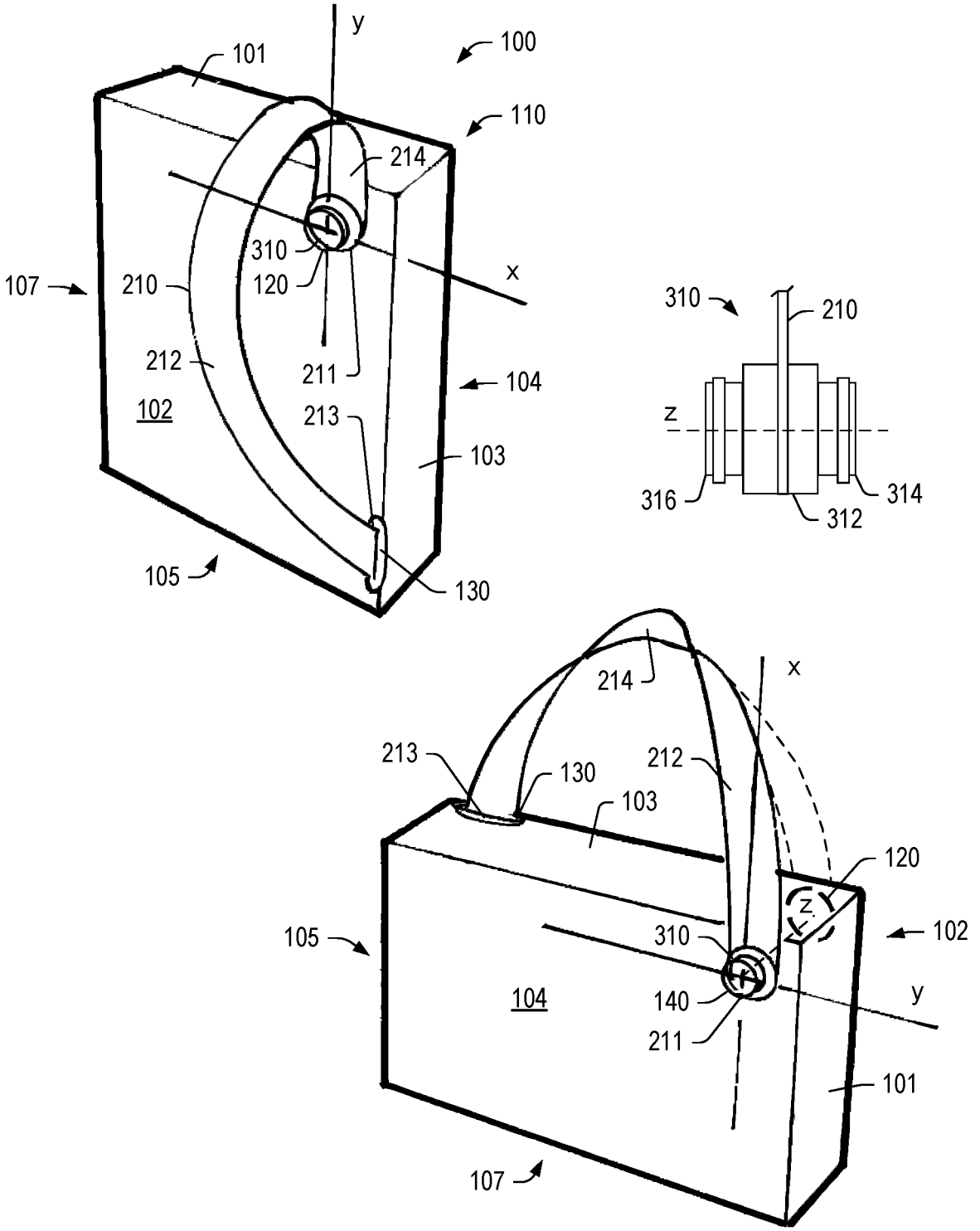
FIG. 1 is a series of diagrams of an example of a carriable device.

FIG. 1 shows an example of a carriable device 100 that includes a body 110 that includes a first side 102, a second, opposing side 104, a first strap mount 120 on the first side 102, and a second strap mount 140 on the second side 104; and a strap 210 that includes an end 213 attached to the body 110, an opposing end 211, and a coupling 310 attached to the opposing end 211, where the coupling 310 is connectable to the first strap mount 120 and where the coupling 310 is connectable to the second strap mount 140.

As shown in FIG. 1, the carriable device 100 can include opposing sides 101 and 105 and opposing sides 103 and 107 where the sides 102 and 104 may be defined by the sides 101, 103, 105 and 107. As shown, the body 110 can include an attachment point 130 where the end 213 of the strap 210 attaches to the body 110. For example, the strap 210 may be stitched to the body 110, glued to the body 110, etc. As shown, the strap 210 can include two opposing sides 212 and 214 where the strap 210 may be relatively flat and pliable such that it can be twisted. The strap 210 may be shaped like a ribbon where a length of the strap 210 between the ends 211 and 213 may be longer than a side dimension or side dimensions of the body 110. For example, the strap 210 can have a length that is longer than the side 101 and/or can have a length that is longer than the side 103. As an example, the strap 210 may be made of a fabric material, a polymeric material and/or one or more other suitable materials.

As shown in FIG. 1, the strap 210 can be transitioned from the side 102 (see, e.g., upper left configuration) to the side 104 (see, e.g., lower right configuration). For example, the mount 310 can be disconnected from the strap mount 120 on the side 102 and then connected to the strap mount 140 on the side 104. As shown, the attachment point 130 may be at a juncture between the sides 102 and 103 or, for example, may be on the side 102 close to the side 103 (e.g., closer to the side 103 than the side 107) or, for example, may be on the side 103 and close to the side 102 (e.g., closer to the side 102 than the side 104).

As an example, the strap 210 may be of suitable width and/or length for ergonomic placement over a shoulder of a user. For example, the strap 210 may be a shoulder strap where the side 102 of the body 110 can be adjacent to a user's back or where the side 102 or 104 may be adjacent to a user's side (e.g., left side or right side). As an example, the strap 210 may be suitable as a hand carry strap such that the body 110 can hang from a user's hand adjacent to a user's right leg or left leg. As an example, the strap 210 may be made of a fabric material, a polymeric material and/or one or more other suitable materials. As an example, the strap 210 may include a cushion, which may be adjustable. For example, consider an adjustable cushion that can be positionable for cushioning against a user's front shoulder surface (see, e.g., upper left configuration) and positionable for cushioning against a user's top shoulder surface (see, e.g., lower right configuration).

FIG. 1 also shows an example of a coupling 310, which may be a single sided coupling or a double sided coupling. As shown, the coupling 310 can hold the strap 210 at or proximate to the end 211, noting that the coupling 310 may be adjustable such as, for example, adjustable by being slidable along the strap 210. In the example of FIG. 1, the coupling 310 includes a strap securing component 312 and one or more connector components 314 and 316 where, for example, the strap securing component 312 can secure the coupling 310 to the strap 210 and where the one or more connector components 314 and 316 can be connected to the body 110 via one of the strap mounts 120 and 140.

In the example of FIG. 1, a coordinate system is shown that includes an x-axis and a y-axis that may be defined along with a z-axis, which, for example, may be utilized to define a thickness of the body 110. In the example of FIG. 1, the z-axis may define a position of the strap mounts 120 and 140. For example, the strap mounts 120 and 140 may be symmetrically located. As an example, the strap mounts 120 and 140 may be not symmetrically located. In the example of FIG. 1, the body 110 includes a long dimension along the y-axis direction and a short dimension along the x-axis direction; noting that a body may be square (e.g., equal dimensions).

In the example of FIG. 1, the strap 210 may be twistable such that it may be twisted, for example, by 180 degrees. For example, consider the coupling 310 as being a single sided coupling that can be oriented by twisting the strap 210 to fit either of the straps mounts 120 and 140. As an example, the strap mounts 120 and 140 can be fixed to the body 110.

As an example, the body 110 and the strap 210 can be connected using a rotatable coupling and mount connection that allows for changing orientation of the body 110 and/or the strap 210. For example, consider the two orientations shown in FIG. 1 where the strap 210 can be used to support the body 110 on a user's back and where the strap 210 can be used to support the body 110 along a user's side. The rotatable coupling and mount connection can provide for locking, unlocking and relocking such that the coupling 310 can be connected to the mount 120 or the mount 140. Such an approach can provide the carriable device 100 with flexibility as to how a user may wish to orient and carry it.

As an example, a body may be a bag, a backpack, a container, a case, an electronic device, etc. For example, as to a case, consider a tablet computing device case, a smartphone case, a notebook computing device case, etc. As an example, a case can include a strap that can be a carrying strap that may form a loop with respect to points on the case where one of the points can include a mount for connection with a coupling of the strap where the mount and coupling allow for rotation such that the strap may be oriented in a desired direction, for example, to facilitate a particular type of carrying (e.g., by hand, over a shoulder, etc.). In such an example, through rotation of the strap at an attachment point via a mount and a coupling, the strap may be adjustable for carrying in one or more manners without disconnecting the coupling from the mount. For example, a carriable device may include a mount on a single side that provides for connection to a coupling of a strap for rotation of the strap. As an example, in FIG. 1, the body 110 may include a single mount on a single side where the mount and the coupling 310 allow for rotation of the strap 210 at the end 211.

Figure 2:
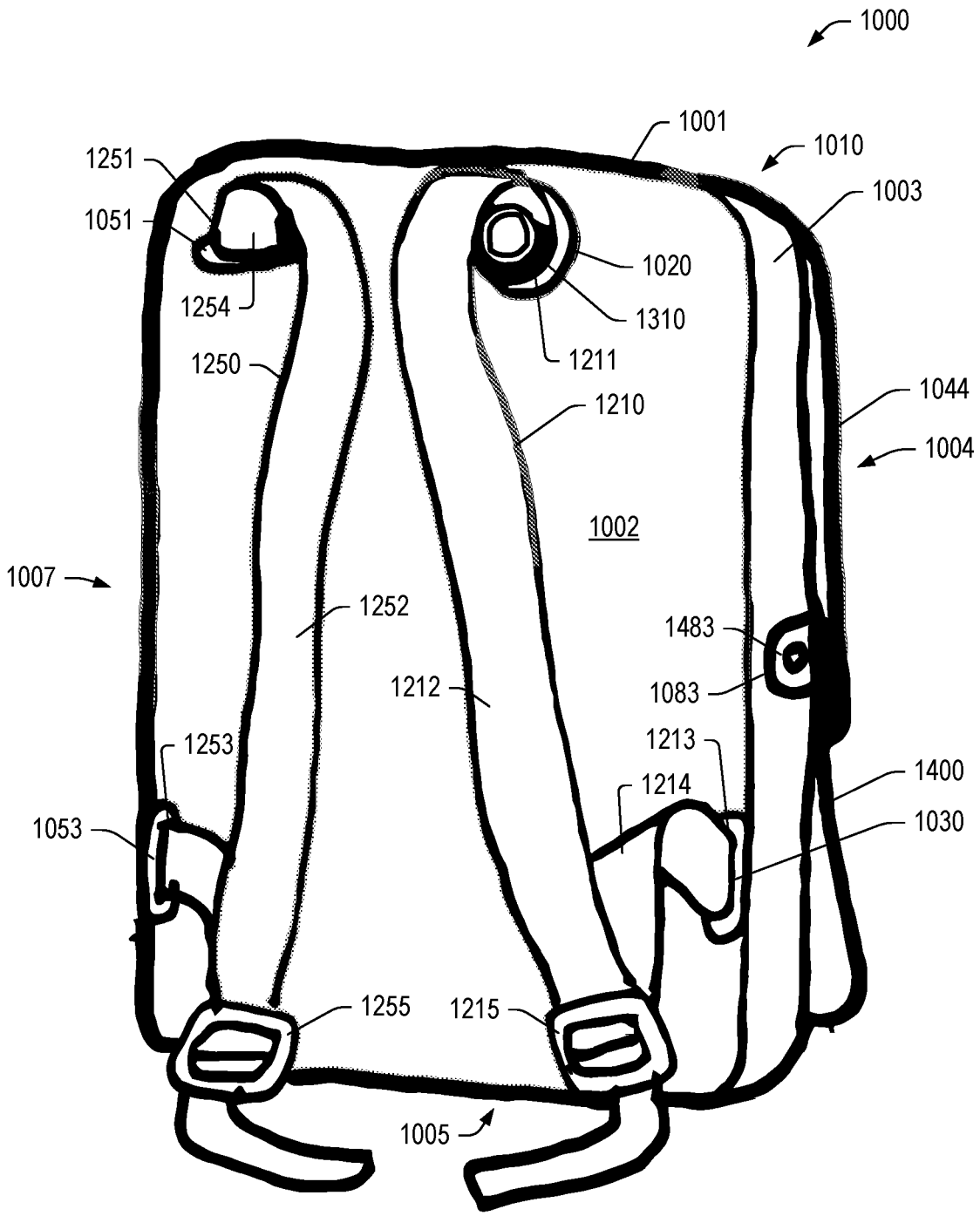
FIG. 2 is a diagram of an example of a carriable device.

FIG. 2 shows an example of a carriable device 1000 that includes a body 1010 and two straps 1210 and 1250. In the example of FIG. 2, the strap 1210 includes a coupling 1310 that can connect to a mount 1020 of the body 1010. In such a configuration, the straps 1210 and 1250 can be backpack straps for carrying the body 1010.

As shown in FIG. 2, the body 1010 includes a back side 1002, a front side 1004, a top side 1001, a bottom side 1005 and opposing lateral sides 1003 and 1007. As shown, the coupling 1310 is on the back side 1002, closer to the top side 1001 than the bottom side 1005 and closer to the side 1003 than the side 1007. Using backpack terminology, the strap 1210 may be referred to as a left shoulder strap where the side 1003 is a left side and the strap 1250 may be referred to as a right shoulder strap where the side 1007 is a right side.

In the example of FIG. 2, the strap 1210 includes ends 1211 and 1213 and sides 1212 and 1214 where an adjustment mechanism such as a buckle 1215 may be positioned along the strap 1210, noting that the strap 1210 may be a multi-piece strap where the pieces join via the buckle 1215. As shown, the body 1010 includes an attachment point 1030 for the end 1213 of the strap 1210. As to the strap 1250, in the example of FIG. 2, it includes opposing ends 1251 and 1253 and sides 1252 and 1254 where an adjustment mechanism such as a buckle 1255 may be positioned along the strap 1250, noting that the strap 1250 may be a multi-piece strap where the pieces join via the buckle 1255. As shown, the body 1010 includes an attachment point 1051 for the end 1251 of the strap 1250 and an attachment point 1053 for the end 1253 of the strap 1250. In the example of FIG. 2, the attachment point 1030 is closer to the side 1003 than the side 1007 and closer to the bottom side 1005 than the top side 1001 and the attachment point 1053 is closer to the side 1007 than the side 1003 and closer to the bottom side 1005 than the top side 1001; noting that the attachment point 1051 is closer to the side 1007 than the side 1003 and closer to the top side 1001 than the bottom side 1005.

In the example of FIG. 2, the carriable device 1000 can include a front side flap 1044 and, for example, a detachable bag 1400, which may include a coupling 1483 that connects to a mount 1083 of the body 1010 (e.g., on the side 1003 of the body 1010).

Figure 3:
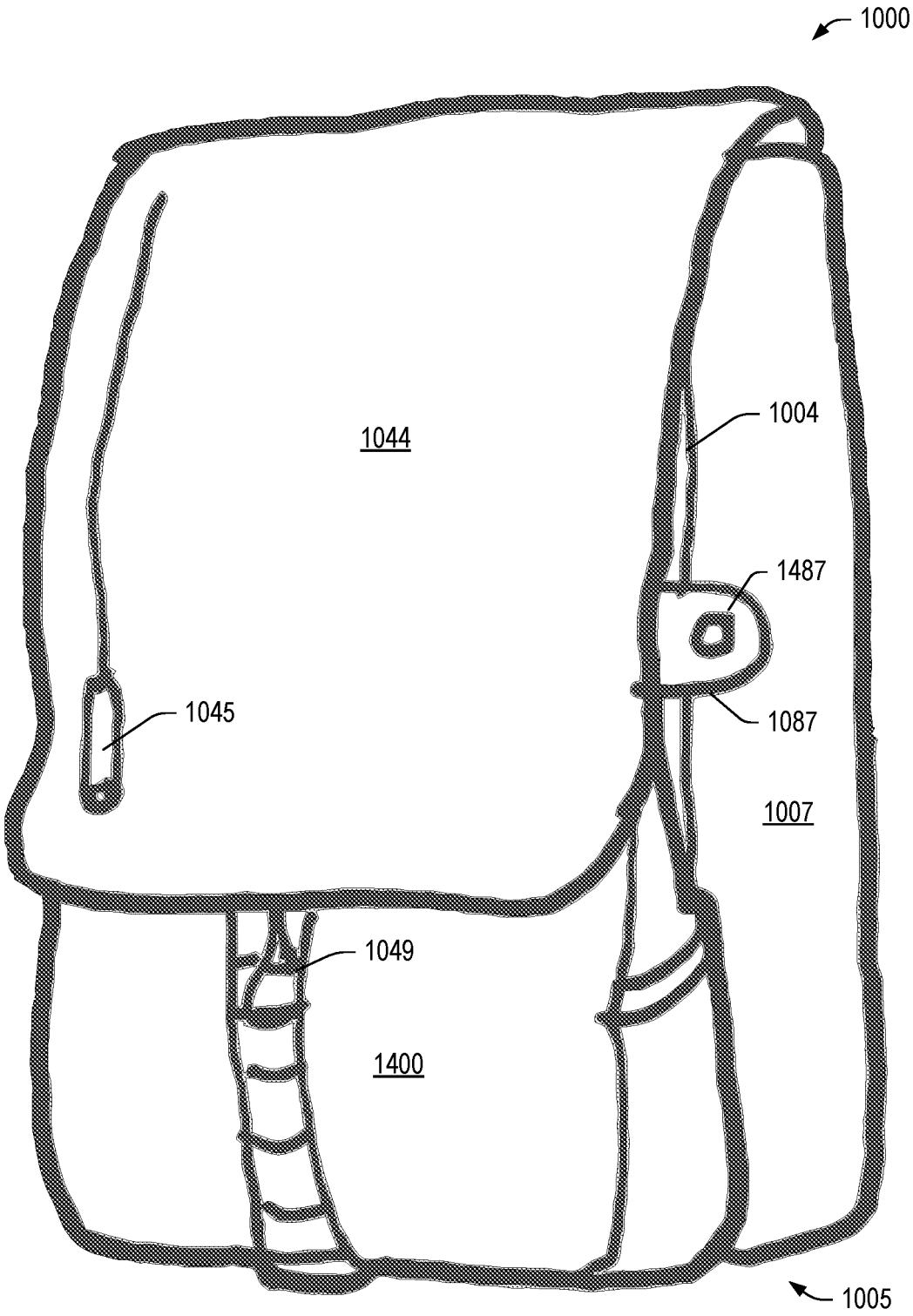
FIG. 3 is a diagram of an example of a carriable device.

FIG. 3 shows an example of the carriable device 1000 where the flap 1044 extends downwardly from the top side 1001 and may optionally include a zipper 1045 for an internal compartment. As shown, the flap 1044 may include a hook 1049 that can be utilized to keep the flap 1044 closed, for example, by connecting with a feature or features of the bag 1400. As shown, the bag 1400 can include another coupling 1487 that connects to another mount 1087 of the body 1010 (e.g., on the side 1007 of the body 1010).

Figure 4:
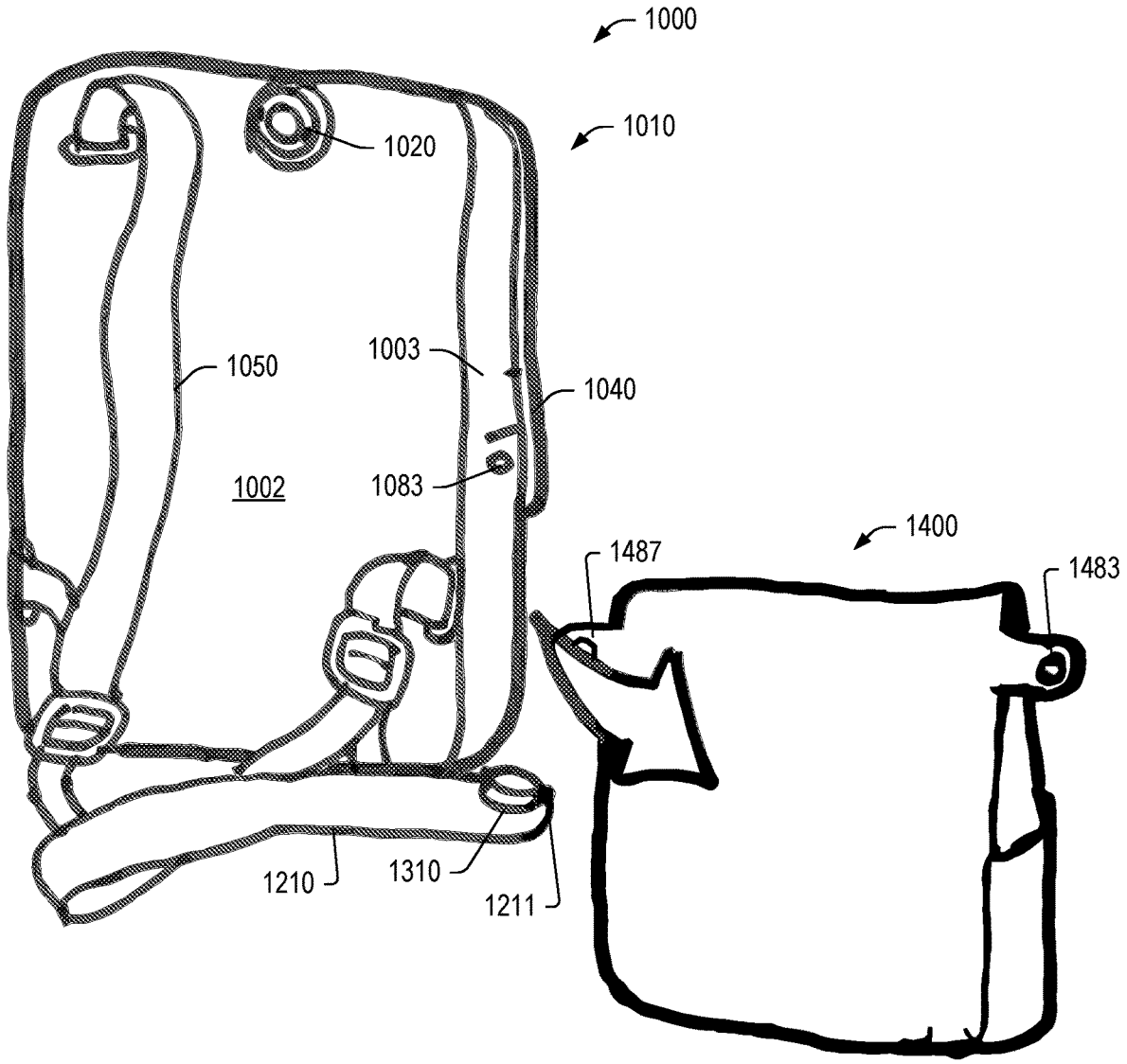
FIG. 4 is a diagram of an example of a carriable device and an example of a detachable bag.

FIG. 4 shows an example of the carriable device 1000 where the bag 1400 is removed from the body 1010 and where the coupling 1310 is disconnected from the mount 1020 on the back side 1002 of the body 1010.

Figure 5:
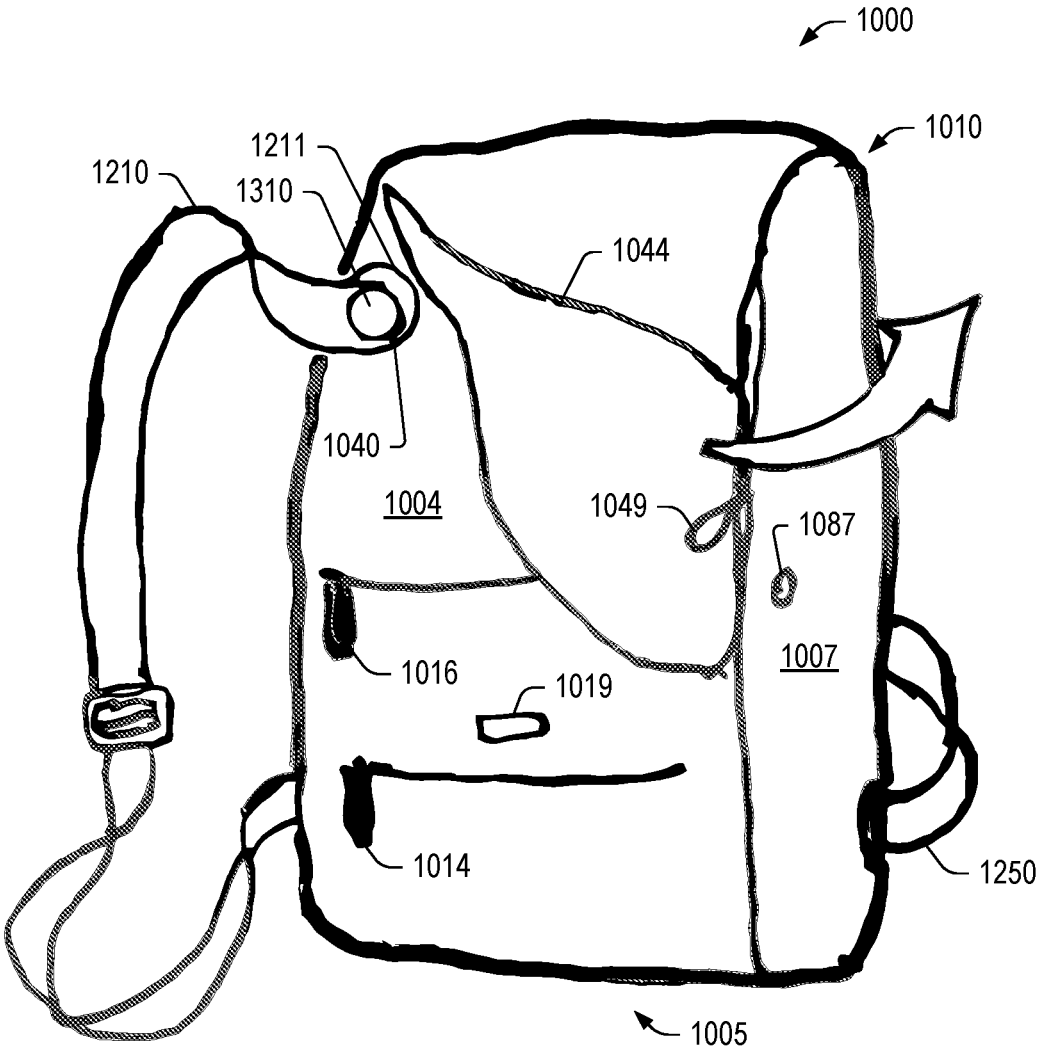
FIG. 5 is a diagram of an example of a carriable device.

FIG. 5 shows an example of the carriable device 1000 where the body 1010 includes a mount 1040 on the front side 1004 of the body 1010. As shown, the front side 1004 of the body 1010 may include one or more zippers 1014 and 1016 for closing and opening one or more compartments (e.g., pockets, etc.) and may include a connector 1019 for connecting the hook 1049 of the flap 1044 to secure the flap 1044 in a closed position on the front side 1004 of the body 1010. As shown in the example of FIG. 5, the flap 1044 can be lifted to reveal the mount 1040 on the front side 1004 of the body 1010 such that the coupling 1310 can be connected to the mount 1040. In such an example, the mount 1020 can be a first mount and the mount 1040 can be a second mount where the mounts 1020 and 1040 can be on opposite sides of the body 1010.

As an example, the flap 1044, if present, may be lifted to reveal an opening to an interior space of the body 1010 or other access feature (e.g., a zipper, etc.) that provides access to an interior space of the body 1010. The body 1010 can include an interior space that may be a single space or a compartmentalized space. As an example, the interior space may be sufficient to receive one or more of books, items of clothing, a notebook computer, a tablet computer, etc.

Figure 6:
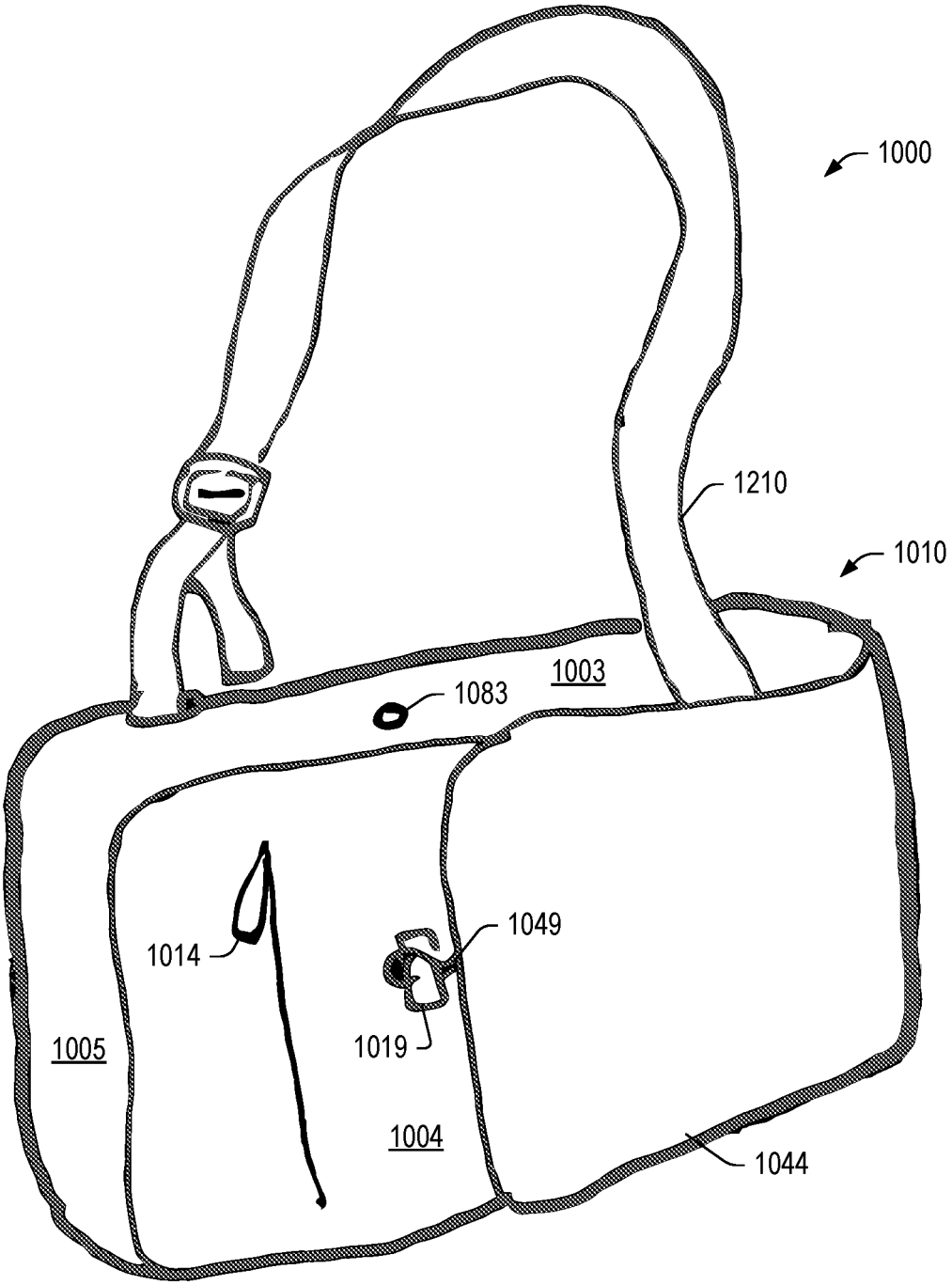
FIG. 6 is a diagram of an example of a carriable device.

FIG. 6 shows an example of the carriable device 1000 in an orientation that differs from the orientation of the carriable device 1000 of FIG. 2. As explained, a carriable device can include mounts and a strap with a coupling where the coupling can be selectably connected to one of the mounts to provide a first configuration of the carriable device and selectably connected to the other one of the mounts to provide a second configuration of the carriable device.

In the example of FIG. 6, the strap 1210 can be a shoulder strap where the body 1010 can be carried along a side of a person (e.g., a left side or a right side), rather than on a person's back (e.g., a back side). In the example of FIG. 6, the flap 1044 is shown as being closed and secured by the hook 1049 and the connector 1019 on the front side 1004 of the body 1010. In such an example, the flap 1044 may remain closed under the force of gravity. As an example, one or more types of mechanisms may be utilized to secure the flap 1044, if present. For example, consider hook material and loop material (e.g., VELCRO material). As shown in the example of FIG. 6, the flap 1044, if present, may help to maintain an orientation of the strap 1210. For example, the flap 1044 may help to maintain the strap 1210 as being substantially flat and parallel to the side 1004, which may help to reduce risk of undesirable twisting of the strap 1210 (e.g., when the body 1010 is being carried by the strap 1210). In such an example, the body 1010 may be more stably carried.

As an example, the carriable device 1000 can be a hybrid bag that can be configured as a backpack and as a side bag. As an example, the configurations may be made using at least two instances of a locking rotatable mount and coupling mechanism. As explained, a carriable device can be a backpack with or without an auxiliary bag and can be changed in orientation creating a messenger bag (e.g., a side bag). A locking rotatable mount and coupling mechanism can allow a strap to be properly oriented in a selected configuration, which may be, for example, a vertical orientation or a horizontal orientation of a carriable device. In a vertical orientation, a long dimension may be oriented substantially along the direction of gravity while, in a horizontal orientation, a long dimension may be oriented substantially orthogonal to the direction of gravity.

As an example, a carriable device can include a backpack orientation mount and a side bag orientation mount where the mounts can be on opposite sides of the carriable device. In such an example, the mounts can both be on a common half of the carriable device, as may be defined by a mid-point of a long dimension of the carriable device. While various examples show such a common half as being a top half of a backpack orientation, as an example, a common half may be a bottom half of a backpack orientation.

Figure 7:
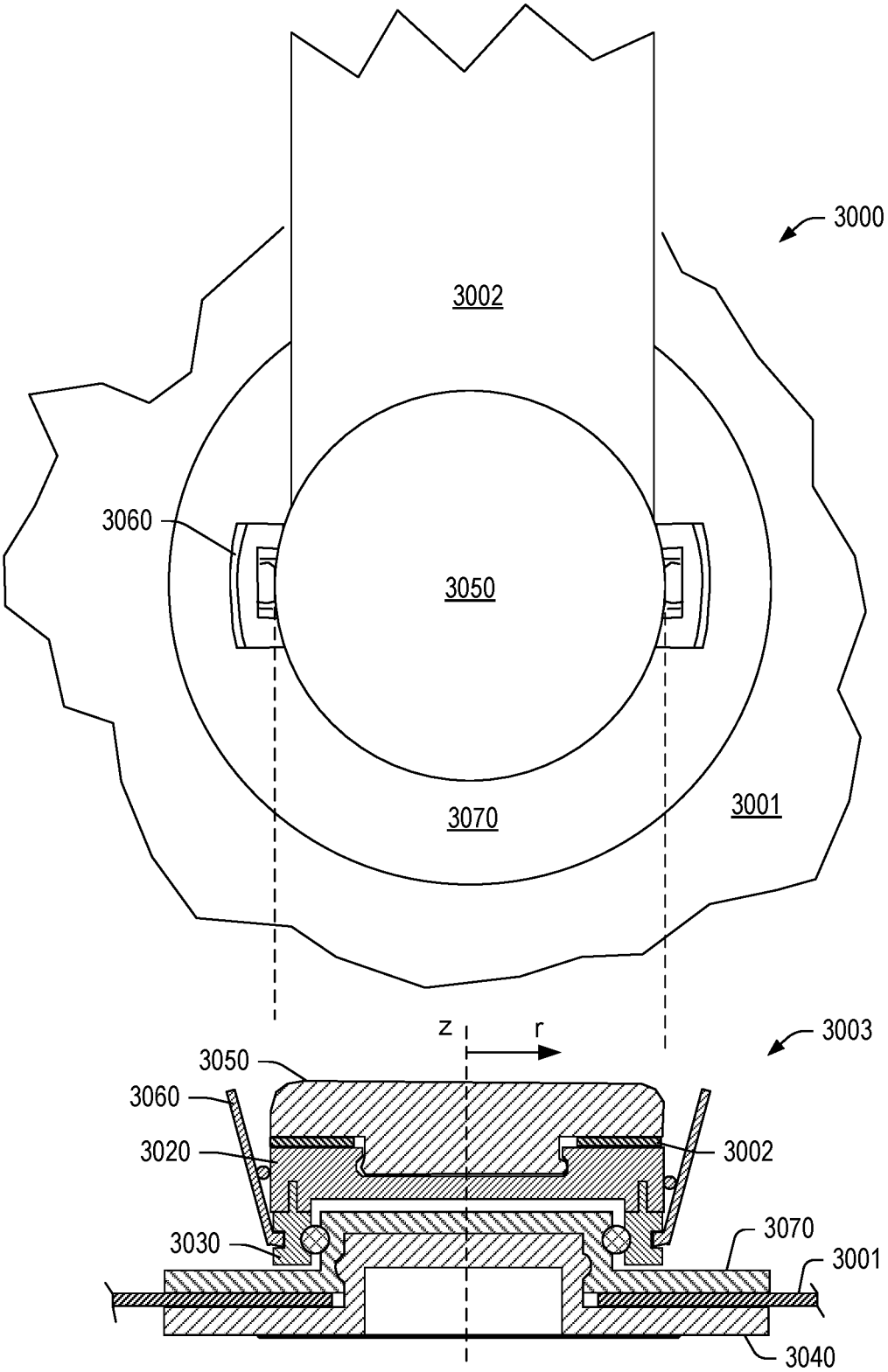
FIG. 7 is a diagram of an example of an assembly.

FIG. 7 shows an example of an assembly 3000 that includes examples of mount and coupling features. As an example, one or more of the mount 120, the mount 140, the coupling 310, the mount 1020, the mount 1040, and the coupling 1310 may include one or more features of the assembly 3000. FIG. 7 also shows an example of a cylindrical coordinate system with a z-axis and a radial, r-axis. One or more features of the assembly 3000 may be defined with respect to one or more coordinate systems.

The assembly 3000 can be a locking rotatable assembly that can function to rotate and can function to lock and unlock. Such functions can provide for changing an orientation of a carriable device by changing an anchor point for a strap of the carriable device.

In the example of FIG. 7, the assembly 3000 can include a body material 3001 of a body and a strap material 3002 of a strap. As shown, the body material 3001 can be clamped between plates 3040 and 3070, which may be interlocking components such as rivet components. A rivet may be formed by pressing or hammering a washer or disk onto a stud that extends through a material. For example, the plate 3040 can act as a stud while the plate 3070 can act as a washer or disk. As shown, the plate 3040 can be hat shaped where a portion extends through an opening of the material 3001 where the plate 3070 can be pressed onto that portion to form a secure, mount at a fixed location on the material 3001.

As an example, the plate 3070 can include a raised cylindrical portion that may be a race or seat for one or more rotating mechanisms. For example, consider a bearing assembly 3030 that can include an outer race for rolling elements where the raised cylindrical portion of the plate 3070 is an inner race for the rolling elements (e.g., ball bearings). In such an example, a plate 3020 can be rotatable via the bearing assembly 3030.

As shown in the example of FIG. 7, the plate 3020 can be utilized in combination with a plate 3050 to secure the strap material 3002. The plates 3020 and 3050 may be interlocking components such as rivet components. For example, the plate 3050 can act as a stud while the plate 3020 can act as a washer or disk. As shown, the plate 3050 can be hat shaped where a portion extends through an opening the material 3002 where that portion of the plate 3050 can be pressed onto the plate 3020, which may include a recess such as a washer type of recess to form a secure, mount at a fixed location on the material 3002.

In the example of FIG. 7, the assembly 3000 may include a latch 3060. For example, consider a tool-less latch that can be operated by a user by pressing two latch levers toward each other using two fingers (e.g., a thumb and a forefinger). In such an example, the latch 3060 can provide for release of the plate 3020 from the bearing assembly 3030 such that the plates 3020 and 3050 that secure the strap material 3002 can be detached from the bearing assembly 3030 and the plates 3040 and 3070 that secure the body material 3001. As an example, a latch may operate utilizing one or more key and keyway features. For example, the latch 3060 may include keys that can be received in one or more keyways of the bearing assembly 3030 and/or one or more other components, which may include a number of keyways such as, for example, a continuous keyway (e.g., 360 degree) or discrete keyways disposed at various angles (e.g., 0 degrees and 180 degrees, 90 degrees and 270 degrees, etc.). As an example, a latch may provide for release of a bearing assembly. For example, consider a bearing assembly that is connected to the plate 3020.

As an example, a bearing assembly may utilize one or more types of components. For example, consider use of a low friction coefficient nylon ring as a continuous bearing rather than rolling element bearings. As an example, a latch may include one or more torsion spring clip components. As an example, a latch may include one or more magnetic materials (e.g., one or more smart programmable magnetic materials). As an example, a latch may include a twist to lock and twist to unlock mechanism (e.g., consider a bayonet type of latch).

Figure 8:
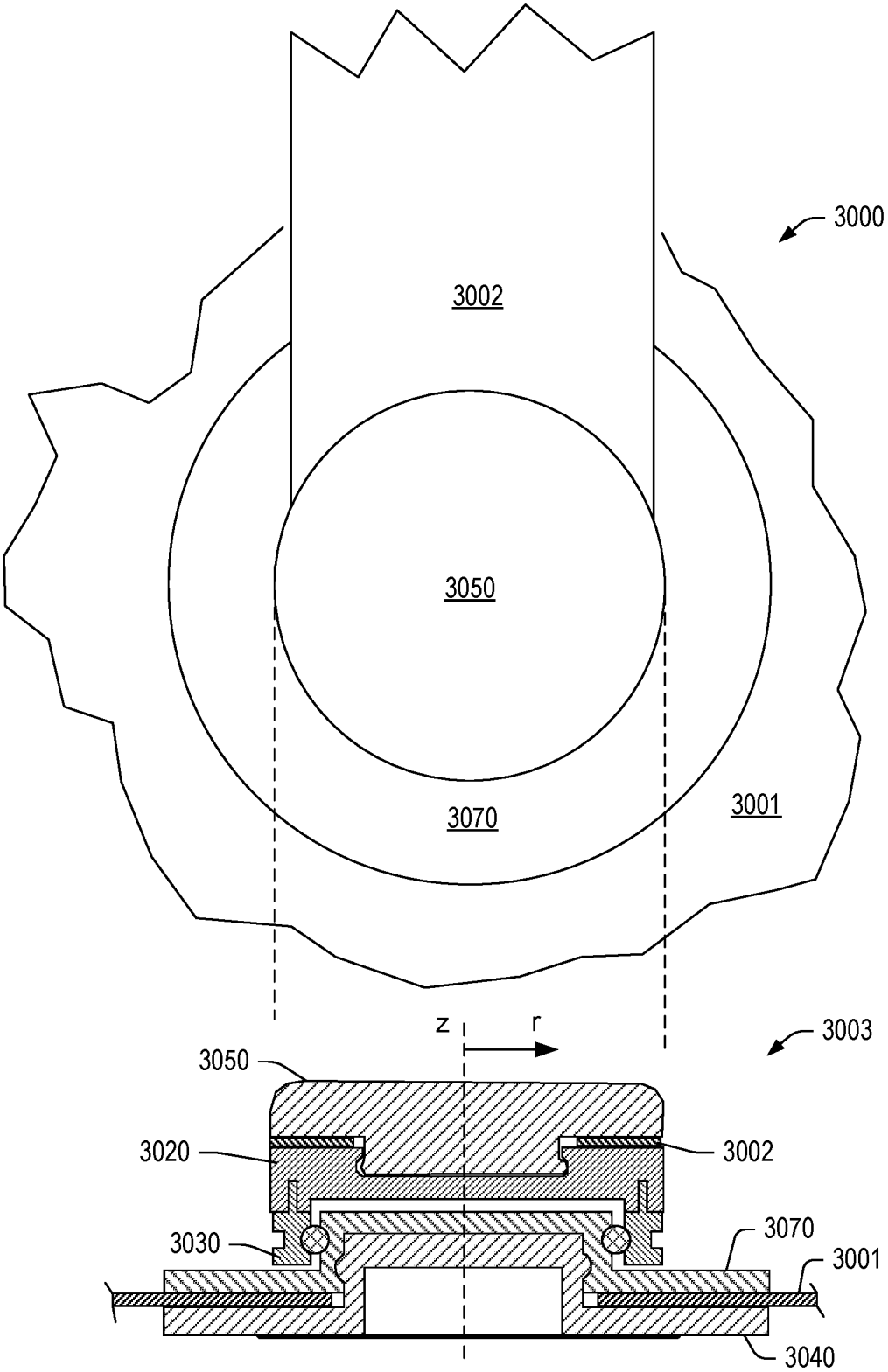
FIG. 8 is a diagram of an example of an assembly.

As an example, a bearing assembly such as, for example, the bearing assembly 3030 of FIG. 7 or FIG. 8, may be limited in rotation. For example, consider a bearing assembly that is limited in rotation to approximately 90 degrees. In such an example, a bearing assembly may be part of a strap mount that is fixed to a material of a body in a particular orientation with respect to the body (e.g., a side or sides, an edge, edges, etc.). In such an example, a strap may be connected to the bearing assembly via a coupling where the coupling and the strap may be rotatable in a range of angles that corresponds to the limited rotation of the bearing assembly. In such an example, an end of the strap may be rotated to a first orientation and rotated to a second orientation where the first and second orientations correspond to different carrying configurations (e.g., consider a backpack type of carrying configuration and a side bag type of carrying configuration).

As explained, a rivet may be utilized to clamp a material or one or more other types of interference fit components may be utilized. As an example, a portion of a rivet may include an integral bearing assembly. For example, consider the plate 3070 and the bearing assembly 3030 as being a unitary component (e.g., a turntable) or, for example, consider the plate 3020 and the bearing assembly 3030 as being a unitary component (e.g., a turntable).

As an example, a locking feature may register with a rotation feature using one or more pins and/or one or more magnets (e.g., with a locking feature).

As an example, an assembly may be relatively low profile to minimize a moment arm. For example, a taller profile of the assembly 3000 may act to increase the moment arm, for example, pulling on a strap can create a greater force on a body of a carriable device and cause it to pull out on one side and in on the other side.

FIG. 8 shows an example of the assembly 3000 where one or more functions of the latch 3060 may be replaced by one or more other features. The rotating device can also be used without the locking feature. For example, the plates 3020 and 3050 may be different and utilize a bayonet type of connection, a magnetic type of connection, etc. As an example, such types of connections may provide for a thinner assembly such that a profile of the assembly 3000 is reduced, which, as explained, may reduce a moment arm and/or other force on the assembly 3000.

Figure 9:
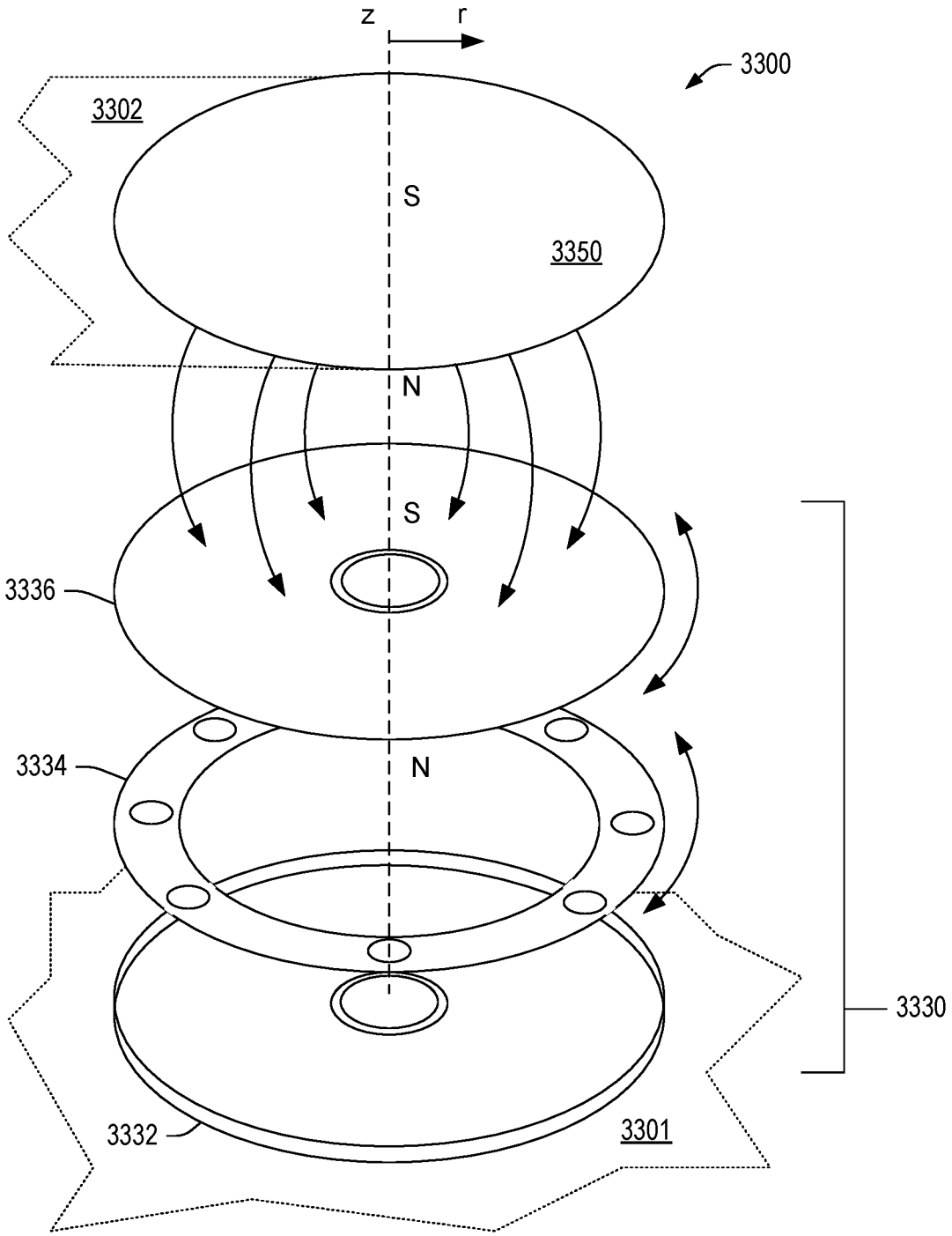
FIG. 9 is a diagram of an example of an assembly.

FIG. 9 shows an example of an assembly 3300 that includes a turntable assembly 3330 that is attached to a material 3301 of a body and a coupling 3350 that is attached to a material 3302 of a strap. FIG. 9 also shows an example of a cylindrical coordinate system with a z-axis and a radial, r-axis. One or more features of the assembly 3300 may be defined with respect to one or more coordinate systems.

In the example of FIG. 9, the turntable assembly 3330 can include a base 3332 attached to the material 3301, a spinning component 3334 and a cap 3336 that can rotate about a z-axis via the spinning component 3334, which may be a low friction coefficient material that may include one or more rolling elements (e.g., balls, etc.). As an example, the cap 3336 can include magnetic material such as one or more permanent magnets and the coupling 3350 can include magnetic material such as one or more permanent magnets. As an example, the base 3332 can couple to the cap 3336 via an axle that may be built into one or more of the base 3332 and the cap 3336 (e.g., consider a central axle, which may be a cylindrical axle that is solid and/or hollow. In FIG. 9, examples of magnetic field lines are shown whereby the coupling 3350 can connect to the cap 3336 via a magnetic attraction force where the cap 3336 is rotatable to accommodate an appropriate orientation of the coupling 3350 about the z-axis, for example, to orient a strap (see, e.g., the material 3302). In the example of FIG. 9, a user may apply force to the coupling 3350 to disconnect it from the cap 3336 of the turntable assembly 3330.

Figure 10:
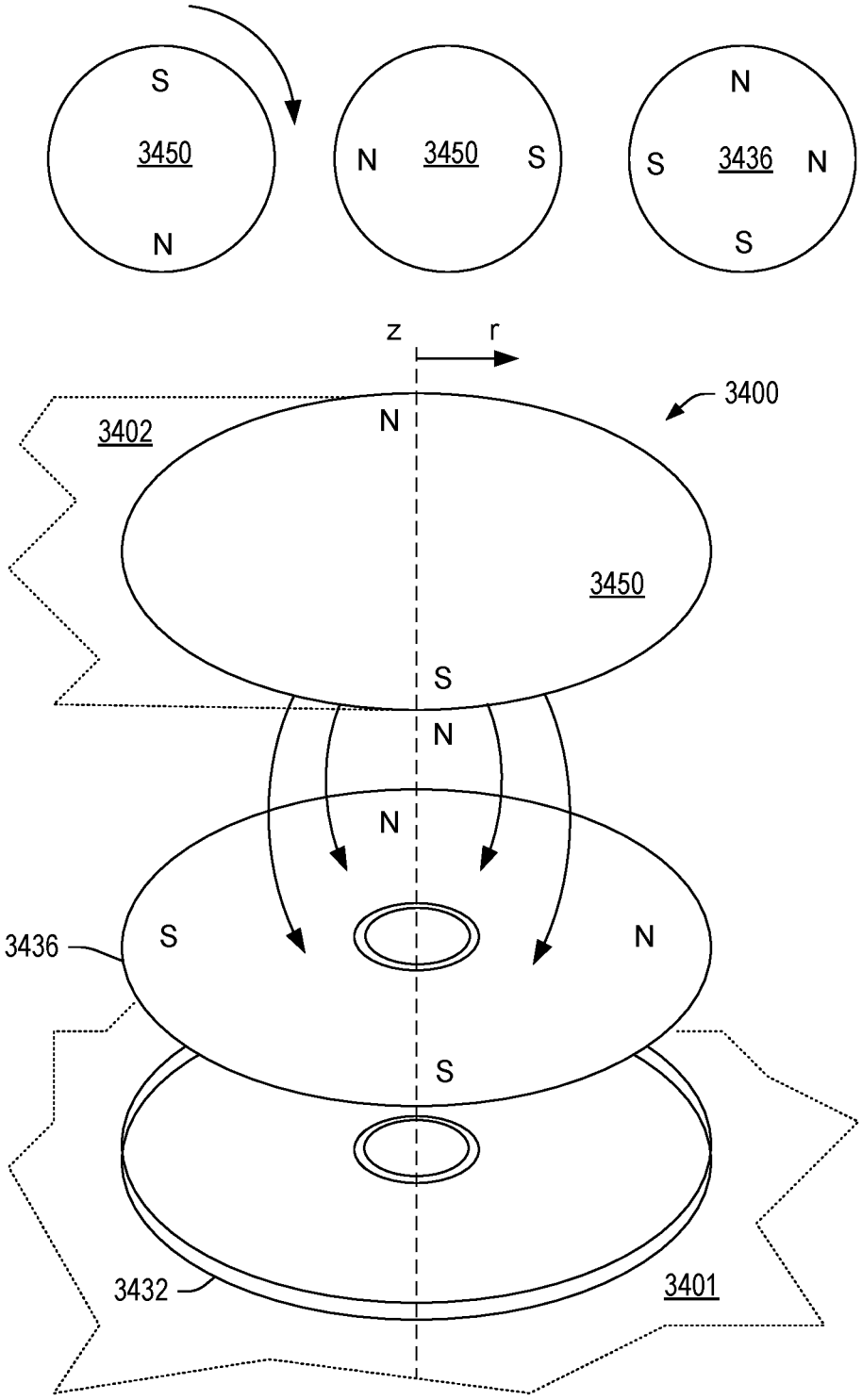
FIG. 10 is a diagram of an example of an assembly.

FIG. 10 shows an example of an assembly 3400 that includes a base 3432 that is attached to a material 3401 of a body and magnetic material 3436 that can be fit to the base 3432 and, for example, oriented as appropriate (e.g., with respect to the body), where a coupling 3450 can be attached to a material 3402 of a strap. FIG. 10 also shows an example of a cylindrical coordinate system with a z-axis and a radial, r-axis. One or more features of the assembly 3400 may be defined with respect to one or more coordinate systems.

In the example of FIG. 10, the magnetic material 3436 can include multiple magnetic poles that are arranged to allow for connection to the coupling 3450 in one or more orientations. For example, consider the magnetic material 3436 as including north poles and south poles that can connect to a north pole and a south pole of the coupling 3450 in two different orientations (e.g., or more). For example, consider two orientations that are approximately 90 degrees apart. In such an example, the coupling 3450 can be utilized to connect to a single mount in two different orientations.

As an example, where a body includes two mounts, each mount may be oriented differently. For example, consider an arrangement of magnets for one mount and another arrangement of magnets for another mount where a coupling is oriented depending on the arrangement of magnets of each of the mounts.

A magnetic material can be a ferromagnetic material, which may be magnetized. A magnet can attract another ferromagnetic material, such as, for example, iron, steel, nickel, cobalt, etc.

A permanent magnet may be made from a material that is magnetized and creates its own persistent magnetic field. Materials that can be magnetized (e.g., ferromagnetic or ferrimagnetic) can include one or more elements such as, for example, one or more of iron, nickel and cobalt and their alloys, some alloys of rare-earth metals, and some naturally occurring minerals such as lodestone. Ferromagnetic materials can be classified as magnetically soft materials like annealed iron, which can be magnetized but do not tend to stay magnetized, and magnetically hard materials, which do. Permanent magnets can be made from hard ferromagnetic materials such as, for example, alnico and ferrite, which may be subjected to special processing in a strong magnetic field during manufacture to align their internal microcrystalline structure.

As explained, a strap can be a carrying strap for a device. For example, consider a shoulder strap that may be utilized in one or more manners (e.g., backpack carrying strap or side bag carrying strap).

As an example, a carriable device can include a body that includes a first side, a second, opposing side, a first strap mount on the first side, and a second strap mount socket on the second side; and a strap that includes an end attached to the body, an opposing end, and a coupling attached to the opposing end, where the coupling is connectable to the first strap mount and where the coupling is connectable to the second strap mount. In such an example, the strap can be a first strap and the carriable device can include a second strap. For example, consider two straps for a body such as a backpack.

As an example, a carriable device can include a body that includes a first side, a second, opposing side, a first strap mount on the first side, and a second strap mount socket on the second side; and a strap that includes an end attached to the body, an opposing end, and a coupling attached to the opposing end, where the coupling is connectable to the first strap mount and where the coupling is connectable to the second strap mount. In such an example, the first side can be a back side of the body and the second side can be a front side of the body. In such an example, an end of the strap that is attached to the body can be attached at the back side of the body and, for example, where the coupling of the strap is connected to the first strap mount, the strap can be a backpack strap and/or, for example, where the coupling of the strap is connected to the second strap mount, the strap can be a side bag strap.

As an example, a carriable device can include a coupling that is rotatably connectable to a first strap mount where the coupling is also rotatably connectable to a second strap mount.

As an example, a first strap mount and a second strap mount can be positioned on a common half of a body. For example, consider a body that includes a top half and a bottom half, where the common half is the top half.

As an example, a body can include a long dimension, a short dimension, and a thickness. In such an example, a position of an end of a strap attached to the body and a position of a first strap mount can span at least 70 percent of the long dimension of the body and a position of the end of the strap attached to the body and a position of a second strap mount can span at least 70 percent of the long dimension of the body.

As an example, a coupling can be a single sided coupling with a single side that is connectable to a first strap mount and, for example, that is connectable to a second strap mount.

As an example, a coupling can be a double sided coupling with a first side that is connectable to a first strap mount and a second side that is connectable to a second strap mount; noting that the first side may be suitable for connecting to the second strap mount and the second side may be suitable for connecting to the first strap mount or, for example, the first side and the second side may differ such as being keyed to connect to a corresponding strap mount (e.g., without being connectable to one or more other strap mounts).

As an example, a carriable device can include a flap, where a second strap mount is coverable by the flap when the flap is in a closed position, and where the second strap mount is exposable by the flap being in at least a partially open position.

As an example, a carriable device can include a first mount that includes a bearing assembly and/or can include a coupling that includes a bearing assembly. As an example, a coupling can include a latch. As an example, a latch may be a hand actuatable latch that can be released by hand, for example, to disconnect a coupling from a strap mount and/or to re-orient a coupling with respect to a strap mount. As an example, a latch may secure a coupling to a strap mount, optionally where an orientation of the coupling with respect to the strap mount may be fixed. For example, consider a coupling and strap mount that may be oriented in a first orientation and oriented in a second orientation where the first and second orientations may be approximately 90 degrees different (e.g., rotated by approximately 90 degrees). In such an example, the first orientation may be an over the shoulder back side orientation (e.g., a backpack type of orientation) and the second orientation may be an over the shoulder lateral side orientation (e.g., a side bag type of orientation).

As an example, a coupling and one or more strap mounts can include magnetic materials. For example, a coupling, a first strap mount and a second strap mount can include magnetic materials. As an example, magnetic materials may be oriented to allow for connecting a coupling to a strap mount in one or more orientations. As an example, different strap mounts may provide for different orientations of a coupling. As explained, a coupling and strap mount may connect in a keyed manner, where a key may be a physical key and/or a magnetic key.

As an example, a carriable device can include a body that includes a strap mount; and a strap that includes an end attached to the body, an opposing end, and a coupling attached to the opposing end, where the coupling is connectable to the strap mount, and where the opposing end of the strap is rotatable via the strap mount and the coupling. In such an example, the strap mount and the coupling may be freely rotatable, for example, via one or more bearing or bearing-like mechanisms and/or may be rotatable in a particular manner, for example, to lock into one or more orientations of the strap mount and the coupling (e.g., 0 degrees, 90 degrees, etc.). As an example, a freely rotatable arrangement of a strap mount and a coupling may include a latch where the latch can lock into one or more orientations of the strap mount and the coupling.

Although examples of methods, devices, systems, etc., have been described in language specific to structural features and/or methodological acts, it is to be understood that the subject matter defined in the appended claims is not necessarily limited to the specific features or acts described. Rather, the specific features and acts are disclosed as examples of forms of implementing the claimed methods, devices, systems, etc.

What is claimed is:

1. A carriable device comprising:

a body that comprises a long dimension and a short dimension of a first side and a second, opposing side, wherein the body further comprises a first strap mount on the first side, and a second strap mount on the second side;

a flap that covers an opening to a compartment of the body; and a strap that comprises an end attached to the body, an opposing end, and a coupling attached to the opposing end, wherein the coupling is connectable to the first strap mount and wherein the coupling is connectable to the second strap mount, wherein the first side is a back side of the body and wherein the second side is a front side of the body, wherein the end of the strap that is attached to the body is attached at the back side of the body, wherein the coupling of the strap is connected to the first strap mount, the strap is a backpack strap for carrying the body in a vertical orientation of the long dimension, wherein the coupling of the strap is connected to the second strap mount, the strap is a side bag strap for carrying the body in a horizontal orientation of the long dimension, wherein the second strap mount is coverable by the flap when the flap is in a closed position, wherein the second strap mount is exposable by the flap being in at least a partially open position, wherein, in the vertical orientation the opening is oriented horizontally, and wherein, in the horizontal orientation, the opening is oriented vertically.

2. The carriable device of claim 1, wherein the strap is a first strap and further comprising a second strap.

3. The carriable device of claim 1, wherein the coupling is rotatably connectable to the first strap mount.

4. The carriable device of claim 1, wherein the coupling is rotatably connectable to the second strap mount.

5. The carriable device of claim 1, wherein the first strap mount and the second strap mount are positioned on a common half of the body.

6. The carriable device of claim 5, wherein the body comprises a top half and a bottom half, wherein the common half is the top half.

7. The carriable device of claim 1, wherein the body comprises a thickness defined between the front side and the back side.

8. The carriable device of claim 7, wherein a position of the end of the strap attached to the body and a position of the first strap mount span at least 70 percent of the long dimension of the body and wherein the position of the end of the strap attached to the body and a position of the second strap mount span at least 70 percent of the long dimension of the body.

9. The carriable device of claim 1, wherein the coupling is a single sided coupling with a single side that is connectable to the first strap mount and that is connectable to the second strap mount.

10. The carriable device of claim 1, wherein the coupling is a double sided coupling with a first side that is connectable to the first strap mount and a second side that is connectable to the second strap mount.

11. The carriable device of claim 1, wherein the first mount comprises a bearing assembly.

12. The carriable device of claim 1, wherein the coupling comprises a bearing assembly.

13. The carriable device of claim 1, wherein the coupling comprises a latch.

14. The carriable device of claim 1, wherein the coupling, the first strap mount and the second strap mount comprise magnetic materials.

15. The carriable device of claim 1, wherein the coupling is rotatably connectable to the first strap mount and wherein the coupling is rotatably connectable to the second strap mount.

16. The carriable device of claim 15, wherein the end attached to the body is stitched to the body.

* * * * *